US009223263B2

(12) United States Patent
Endo

(10) Patent No.: US 9,223,263 B2
(45) Date of Patent: Dec. 29, 2015

(54) IMAGE FORMING APPARATUS WITH A FIXING DEVICE HAVING REGULATING MEMBER TO REGULATE AN EDGE OR END OF A SHEET WHEN ENTERING A BACK SIDE OF A GUIDE MEMBER

(71) Applicant: CANON KABUSHIKI KAISHA, Tokyo (JP)

(72) Inventor: Michiaki Endo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/077,297

(22) Filed: Nov. 12, 2013

(65) Prior Publication Data

US 2014/0161502 A1 Jun. 12, 2014

(30) Foreign Application Priority Data

Dec. 6, 2012 (JP) ..... 2012-267225

(51) Int. Cl.
*G03G 15/00* (2006.01)
*G03G 15/20* (2006.01)

(52) U.S. Cl.
CPC ..... *G03G 15/2028* (2013.01); *G03G 15/2085* (2013.01); *G03G 15/657* (2013.01)

(58) Field of Classification Search
CPC . G03G 15/70; G03G 15/657; G03G 15/2028; G03G 15/2085; G03G 2221/1675
See application file for complete search history.

(56) References Cited

U.S. PATENT DOCUMENTS

| | | | | |
|---|---|---|---|---|
| 7,480,480 | B2 | 1/2009 | Endo et al. | |
| 7,505,725 | B2 | 3/2009 | Katayama et al. | |
| 7,546,078 | B2 | 6/2009 | Okuda et al. | |
| 2004/0114952 | A1 * | 6/2004 | Yamamoto | 399/69 |
| 2009/0220287 | A1 * | 9/2009 | Okano et al. | 399/322 |
| 2012/0224894 | A1 * | 9/2012 | Yamada | 399/327 |

FOREIGN PATENT DOCUMENTS

JP 5-341680 A 12/1993

* cited by examiner

*Primary Examiner* — Blake A Tankersley
(74) *Attorney, Agent, or Firm* — Fitzpatrick, Cella, Harper & Scinto

(57) ABSTRACT

An image forming apparatus is designed to easily recover a jammed sheet nipped by a fixing roller and a pressure roller. In an entrance guide which guides a sheet to a fixing nip portion between the fixing roller and the pressure roller, a bending portion is provided on a back side of a guide face which guides the sheet to the fixing nip portion. Then, when the sheet to be discharged toward the entrance guide by a manual discharge member enters the back side of the entrance guide, a downstream end of the sheet, in a discharging direction of the sheet, is locked to the bending portion, and thus the central portion of the sheet in the sheet discharging direction is bent along the surface of the guide face by discharging the sheet in a state where the downstream end in the discharging direction is locked.

9 Claims, 13 Drawing Sheets

IMAGE FORMING APPARATUS WITH A FIXING DEVICE HAVING REGULATING MEMBER TO REGULATE AN EDGE OR END OF A SHEET WHEN ENTERING A BACK SIDE OF A GUIDE MEMBER

BACKGROUND OF THE INVENTION

1. Field of the Invention

The present invention relates to an image forming apparatus and, more particularly, to a configuration of a fixing device which fixes a toner image transferred to a sheet on the sheet by a fixing roller and a pressure roller.

2. Description of the Related Art

In the related art, an image forming apparatus such as a copying machine, a printer, a facsimile, or a complex machine, which forms an image by an electrophotographic system includes an image forming portion which forms a toner image, a transfer portion which transfers the toner image onto a sheet, and a fixing device which fixes the transferred toner image on the sheet. The fixing device is provided with a fixing roller, a pressure roller, and an entrance guide member, which guides a sheet with an unfixed toner image to a nip portion between the fixing roller and the pressure roller.

In the fixing device of the related art, by the way, when the sheet is jammed at a downstream of the nip portion between the fixing roller and the pressure roller, as illustrated in FIG. 13A, a jammed sheet P will be stopped in the state of being nipped by a fixing roller 1201 and a pressure roller 1203. In this case, a jam recovery operation is performed in such a manner that the jammed sheet P is reversely conveyed upstream in a sheet conveying direction by rotating the fixing roller 1201 in a counterclockwise direction indicated by an arrow.

At this time, however, as illustrated in FIG. 13B, the jammed sheet P sometimes enters between an entrance guide 1205 and the pressure roller 1203 depending on a sheet state. In this case, the entrance guide 1205 has to be detached in order to recover the jammed sheet. In order to prevent the jammed sheet P from entering between the entrance guide 1205 and the pressure roller 1203, a technique of disposing a plate-shaped auxiliary guide member, which varies in a thickness direction of the sheet, on a tip end of the entrance guide 1205 is disclosed in Japanese Patent Laid-Open No. 05-341680.

In the image forming apparatus of the related art including the fixing device, when the auxiliary guide member is disposed on the tip end of the entrance guide, the jammed sheet sometimes abuts the auxiliary guide member, depending on the position of the auxiliary guide member at the time of reversely conveying the jammed sheet. At this time, when the stiffness of the auxiliary guide member is weaker than that of the jammed sheet, the jammed sheet enters the lower side of the entrance guide along with a reverse rotation of the fixing roller, and thus it is difficult to recover the jammed sheet.

The invention has been made in view of such circumstances and is to provide an image forming apparatus capable of easily recovering the jammed sheet which is nipped by the fixing roller and the pressure roller.

SUMMARY OF THE INVENTION

The invention is to provide an image forming apparatus including an image forming portion which forms a toner image, a transfer portion which transfers the toner image onto a sheet, and a fixing device which fixes the transferred toner image on the sheet. In the image forming apparatus, the fixing device includes a fixing roller, a pressure roller which is pressed against the fixing roller, a guide member which guides the sheet to a nip portion between the fixing roller and the pressure roller, a manual discharge member which is manually operated to move the sheet in a state of being nipped by the nip portion toward the guide member, and a locking member which is provided on a back side of a guide face, which guides the sheet to the nip portion of the guide member, such that a central portion of the sheet is bent along a surface of the guide face by a locking of a downstream-side end thereof in a moving direction of the sheet when the sheet to be moved by the manual discharge member enters the back side of the guide member.

Further features of the present invention will become apparent from the following description of exemplary embodiments with reference to the attached drawings.

DESCRIPTION OF THE EMBODIMENTS

Figure 1:
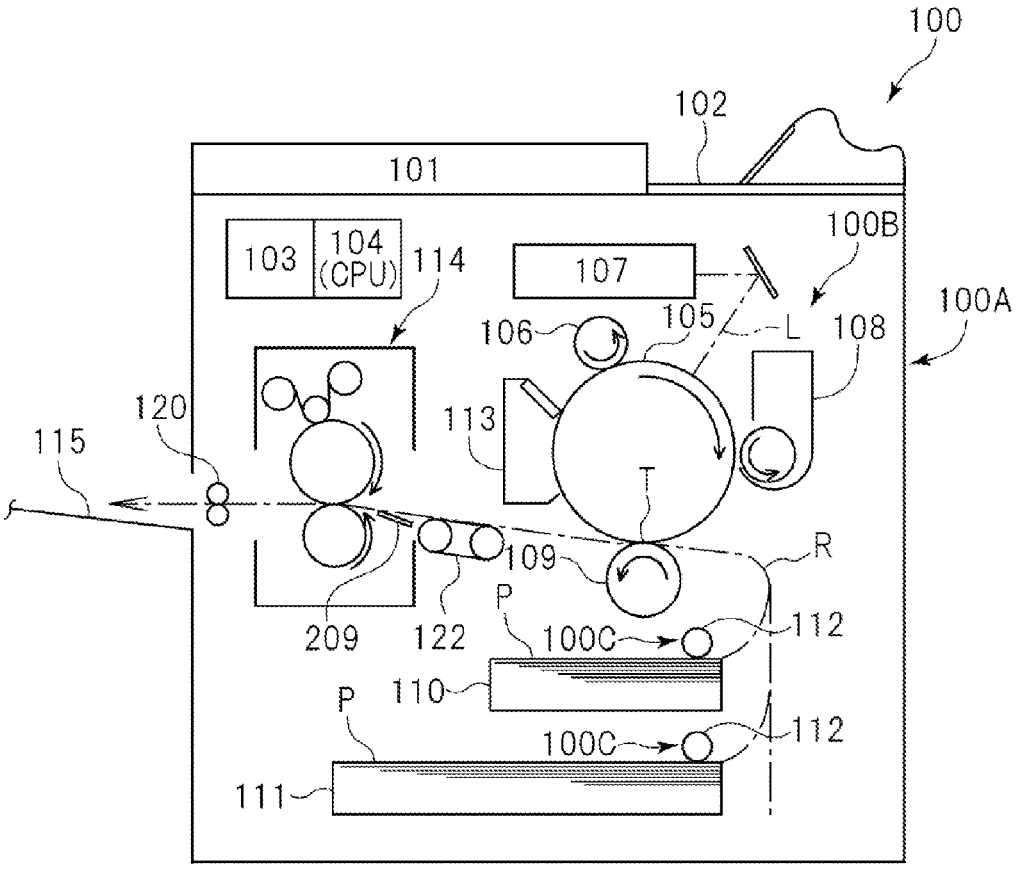
FIG. 1 is a diagram illustrating a configuration of an image forming apparatus according to an embodiment of the invention.

Hereinafter, an embodiment carrying out the invention will be described in detail with reference to accompanying drawings. FIG. 1 is a diagram illustrating a configuration of an image forming apparatus according to the embodiment of the invention. Moreover, the image forming apparatus according to the present embodiment is an image forming apparatus of a laser-scanning exposure system using a transfer-type electrophotographic process.

In FIG. 1, an image forming apparatus 100 and an image forming apparatus body (hereinafter, referred to as an apparatus body) 100A are illustrated. Further, an original reading device (image scanner) 101 and a region designation device (digitizer) 102 are arranged on an upper face of the apparatus body 100A. In addition, an image forming portion 100B and a sheet feeding portion 100C, which feeds a sheet to the image forming portion 100B, are arranged inside the apparatus body 100A.

The original reading device 101 scans an original face placed on an original base plate (not illustrated), which is provided in the original reading device 101, using a scanning illumination optical system provided therein, reads out reflection light from the original face by an optical sensor such as a CCD line sensor, and converts image information into a time-series digital electric signal. The region designation device 102 sets a reading region of an original to output the signal.

The image forming portion 100B is provided with an electrophotographic photoreceptor (hereinafter, referred to as a photosensitive drum) 105 of a rotary-drum type as an image bearing member and an image writing device 107. Furthermore, in the present embodiment, the image writing device 107 is a laser scanner. In addition, the sheet feeding portion 100C is provided with sheet feeding cassettes 110 and 111 and a pickup roller 112 which feeds a sheet P stored in the sheet feeding cassettes 110 and 111. A controller (CPU) 104 receives a signal from the original reading device 101, the region designation device 102, and a print controller 103 to perform a signal processing, which sends a command to each portion of an image outputting mechanism, and various image-forming sequence controls.

Next, an image forming operation of the image forming apparatus 100 configured as described above will be described. When the original (not illustrated) is read by the original reading device 101, the read original image is converted into the time-series digital electric signal and is then sent to the controller (CPU) 104 such that the signal processing is performed by the controller (CPU) 104. Thereafter, a laser beam is emitted toward the photosensitive drum 105 from the image writing device 107 in accordance with the signal-processed image data. Furthermore, at this time, the photosensitive drum 105 is driven to rotate at a predetermined circumferential velocity in a clockwise direction illustrated by an arrow, and the surface of the photosensitive drum 105 is uniformly charged, as predetermined polarity and potential are subjected to a uniform charging processing using a charging device 106 during a rotation process. When the photosensitive drum 105 is irradiated with the laser beam emitted from the image writing device 107, an electrostatic latent image is formed on the photosensitive drum, and then a toner image is formed on the photosensitive drum by developing the electrostatic latent image with a developing device 108 using a toner.

The sheet P stored in the sheet feeding cassettes 110 and 111 is delivered by the pickup roller 112 in conjunction with the image forming operation. Thereafter, the delivered sheet P passes through a sheet conveying path R and is sent to a transfer portion T including the photosensitive drum 105 and the charging device 106 in synchronization with the rotation of the photosensitive drum 105. Then, the toner image on the photosensitive drum 105 is electrostatically transferred onto the sheet P in the transfer portion T.

Next, the sheet P, onto which the toner image is transferred, is separated from the photosensitive drum 105 and is then conveyed to a fixing device 114 by a conveying belt 122 as a conveying portion. When the sheet P is subjected to heating and pressure treatments by the fixing device 114, the toner image is fixed on the sheet P. Then, the sheet P, on which the toner image is fixed, is discharged on a sheet discharging tray 115 provided outside the apparatus body by a discharge roller 120. Furthermore, after the sheet separation, contaminants such as a transfer residual toner adhered to the photosensitive drum 105 are removed and cleaned by a cleaning device 113, and then an image is repeatedly formed on the photosensitive drum 105.

Figure 2:
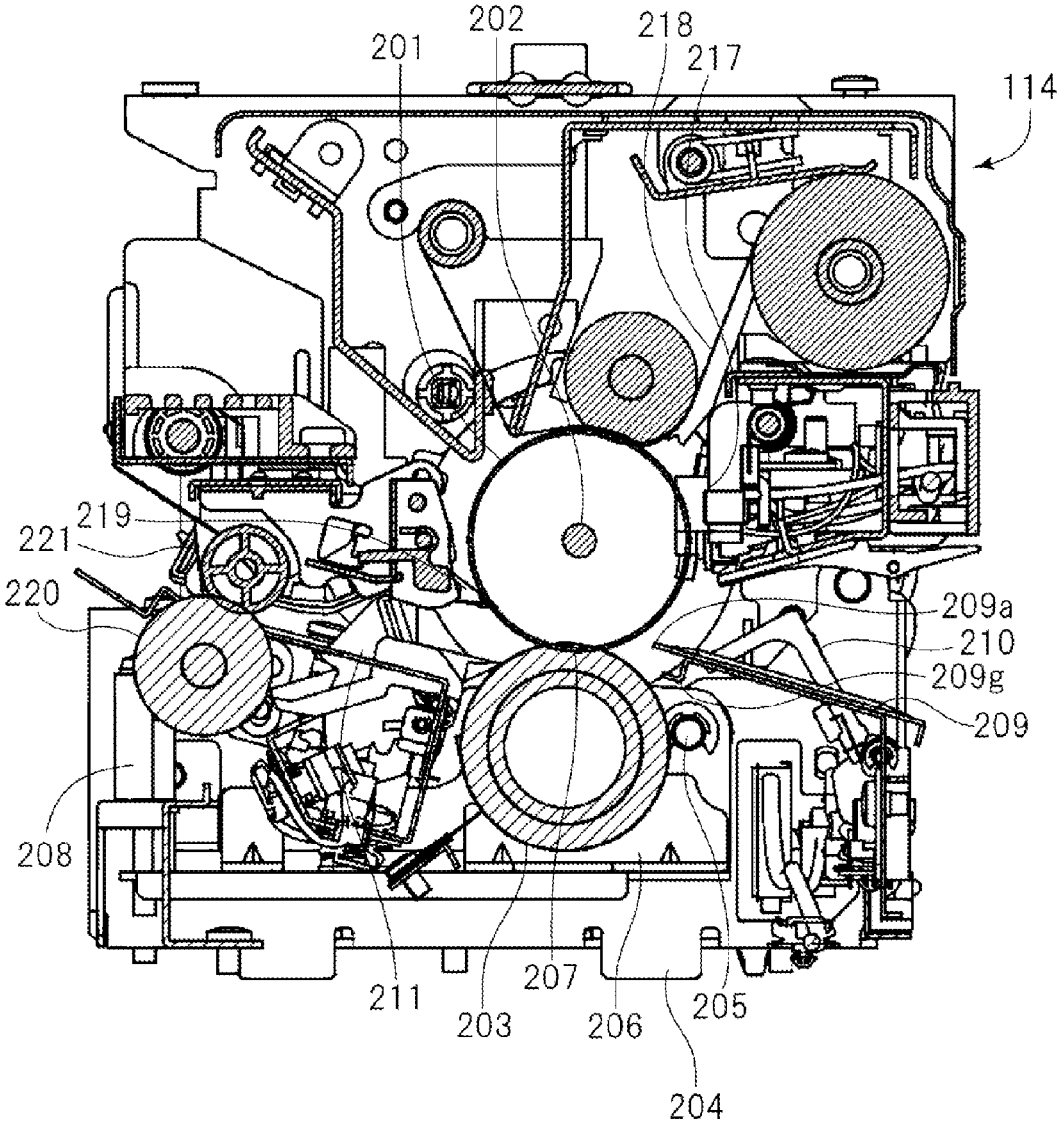
FIG. 2 is a diagram illustrating a configuration of a fixing device provided in the image forming apparatus.

FIG. 2 is a diagram illustrating a configuration of the fixing device 114. The fixing device 114 includes a fixing roller 201 and a pressure roller 203, which is pressed against the fixing roller 201. Here, the fixing roller 201 is rotatably supported on a frame (not illustrated) of the fixing device 114 through a bearing, and a halogen heater 202 is disposed inside the fixing roller 201. The fixing roller 201 as a metal roller is made of a high tension steel having a thickness of 0.65 mm as a mandrel, and a PFA tube of 30 μm is bonded to the outer circumference of the mandrel, and thus the external shape of the fixing roller 201 becomes ϕ 40.3 mm.

The pressure roller 203 is rotatably supported on a pressure arm 206 using a rotation center shaft 205, which is provided in a pressure frame 204, as a rotation center through a bearing (not illustrated). Here, the mandrel of the pressure roller 203 is made of stainless steel to which silicon rubber having the hardness of 73 degrees is bonded. The PFA tube is bonded to the outer circumference of the silicon rubber in the same manner as the fixing roller 201, and thus the external shape of the pressure roller 203 becomes ϕ 40 mm.

Further, all of the pressure arm 206, the pressure frame 204, and the rotation center shaft 205 are made of steel. In addition, a nip pressure of a nip portion (hereinafter, referred to as a fixing nip portion) 207 formed between the fixing roller 201 and the pressure roller 203 becomes a pressure having a predetermined intensity by a spring 208, which causes the pressure arm 206 to be raised toward the fixing roller.

In addition, an entrance sensor 210, a fixing exit sensor 211, and an abnormality detection sensor (not illustrated), which detects abnormality of the sheet conveyance, such as a jamming, are disposed in the fixing device 114. Furthermore, all sensors are sensors of a type combining a sensor flag and a photo sensor in the present embodiment. In addition, a temperature detecting thermistor 217, which detects the surface temperature of the fixing roller 201, a web 218, which cleans a surface of the fixing roller, and a thermo-switch (not illustrated), which stops a power supply when the abnormality occurs in the surface temperature of the fixing roller, are arranged around the fixing roller 201.

Moreover, a fixing separation claw 219 is arranged in the fixing device 114 to reliably separate the sheet, on which the toner image is fixed, from the surface of the fixing roller when passing through the fixing nip portion 207. In addition, an inner discharge roller 220 and a roller 221 are arranged in the fixing device 114 to discharge the sheet, on which the toner image is fixed, to the sheet discharging tray 115.

By the way, an entrance guide 209, as a guide member, is installed upstream, in the sheet conveying direction, of the fixing nip portion 207 to make the sheet P, on which the toner image is transferred and conveyed, smoothly enter the fixing nip portion 207.

Figure 3:
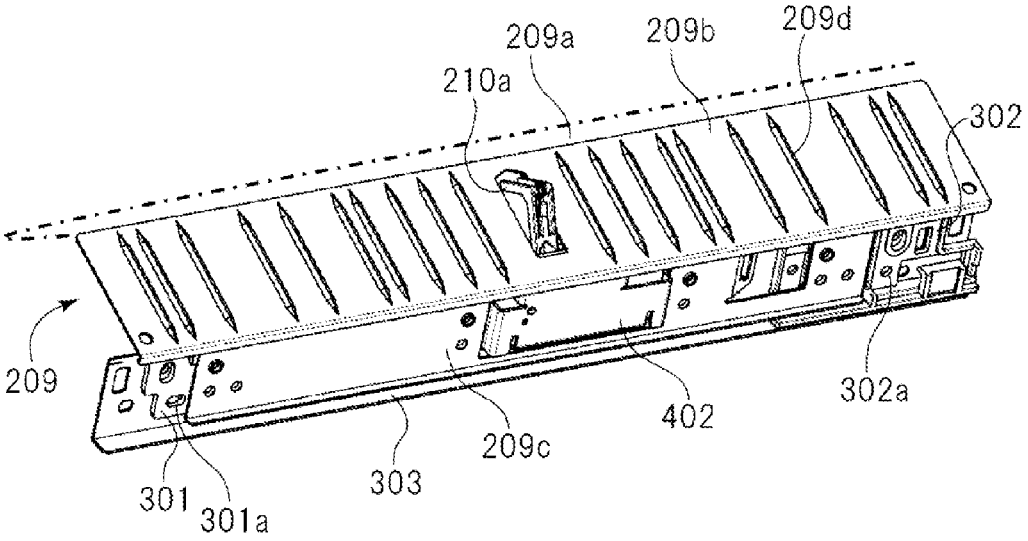
FIG. 3 is a first diagram illustrating a configuration of an entrance guide provided in the fixing device.

As illustrated in FIG. 3, an upper face of the entrance guide 209 is provided with a sheet passing member 209*b*, which includes a guide face for guiding the sheet to the fixing nip portion 207, and an auxiliary member 209*c* that is coupled to the sheet passing member 209*b* by a caulking member. The sheet passing member 209*b* is made of stainless steel such that the sheet smoothly passes, and a diaphragm-shaped rib 209*d* is longitudinally provided on the surface of the sheet passing member 209*b* to reduce resistance when the sheet passes through the sheet passing member 209*b*. In addition, the auxiliary member 209*c* is made of soft steel to ensure strength.

Height adjustment racks 301 and 302 are fastened with screws at both ends in a width direction perpendicular to the sheet conveying direction of the auxiliary member 209*c* such that a position is uniquely determined with respect to the auxiliary member 209*c*. Further, the height adjustment racks 301 and 302 are formed using a resin material having a resistance value of $10^4$ to $10^5$ Ωcm such that the entrance guide 209 prevents electricity from directly flowing to ground.

Here, since the entrance guide 209 determines the entrance posture of the sheet, onto which the toner image is transferred, into the fixing nip portion 207, the shape and attaching accuracy thereof are very important. Specifically, adjustment by ±0.1 mm in a height direction with respect to the fixing nip portion 207 is required for a position of a tip end 209*a*, which is an end of the entrance guide 209 at the nip portion side. When this position suffers a deviation, it is difficult to hold the entrance posture of the sheet into the fixing nip constant, and as a result, wrinkles may occur in the sheet or an abnormal image may occur due to friction of an unfixed toner image.

For this reason, an entrance guide adjustment plate 303 is disposed such that the position of the entrance guide 209 is reproduced even when the entrance guide 209 is detached from the frame and then is assembled again due to the reason of maintenance of the fixing device 114. Then, embosses (not illustrated) out of the height adjustment racks 301 and 302 are fastened to holes 301*a* and 302*a* of the height adjustment racks 301 and 302 by matching with each other with screws. When the entrance guide 209 is attached to the frame, a method of adjusting the attachment position of the entrance guide 209 will be described below.

Figure 4:
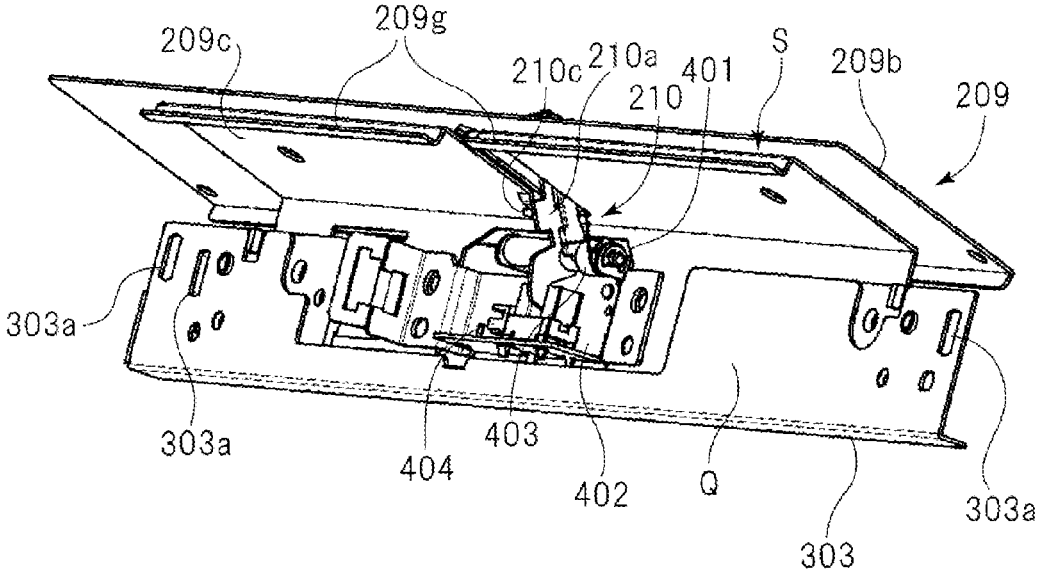
FIG. 4 is a second diagram illustrating a configuration of the entrance guide.

FIG. 4 is a diagram when the entrance guide 209 is viewed from downstream thereof in the sheet conveying direction. In FIG. 4, an entrance sensor flag 210*a* is supported on an entrance sensor support plate 402 so as to be capable of rotating around a rotation shaft 401. In addition, the entrance sensor flag 210*a* is pushed up toward a sheet passing face by a torsion coil spring 403 and is adapted to protrude upward from the sheet passing member 209*b* to a predetermined extent, as a stopper 210*c* abuts on the auxiliary member 209*c*.

Then, when the sheet passes through the upper face of the sheet passing member 209*b*, the entrance sensor flag 210*a* is pressed by the sheet to rotate and blocks out a photo sensor 404 included in the entrance sensor 210 from light together with the entrance sensor flag 210*a*. Therefore, the controller (CPU) 104 can detect the passage of the sheet and the presence or absence of the sheet on the sheet passing member 209*b*. Furthermore, the entrance guide 209 is attached to the frame in unit state illustrated in FIG. 4. At this time, the attachment is performed such that the Q surface of the entrance guide adjustment plate 303 comes in contact with the frame.

Meanwhile, a crank-shaped bending portion 209*g* is provided on the end of the auxiliary member 209*c* at the fixing nip portion side. The bending portion 209*g* has an L-shape in cross-section such that an end protrudes toward the fixing nip portion 207. Then, as will be described later, when the sheet enters the back side of the entrance guide 209 by the sheet passing member 209*b* and the auxiliary member 209*c*, a space S, in which the fixing nip direction for locking the downstream side end in a discharging direction of the sheet is opened, is formed by providing the bending portion 209*g* in this manner.

Figure 5:
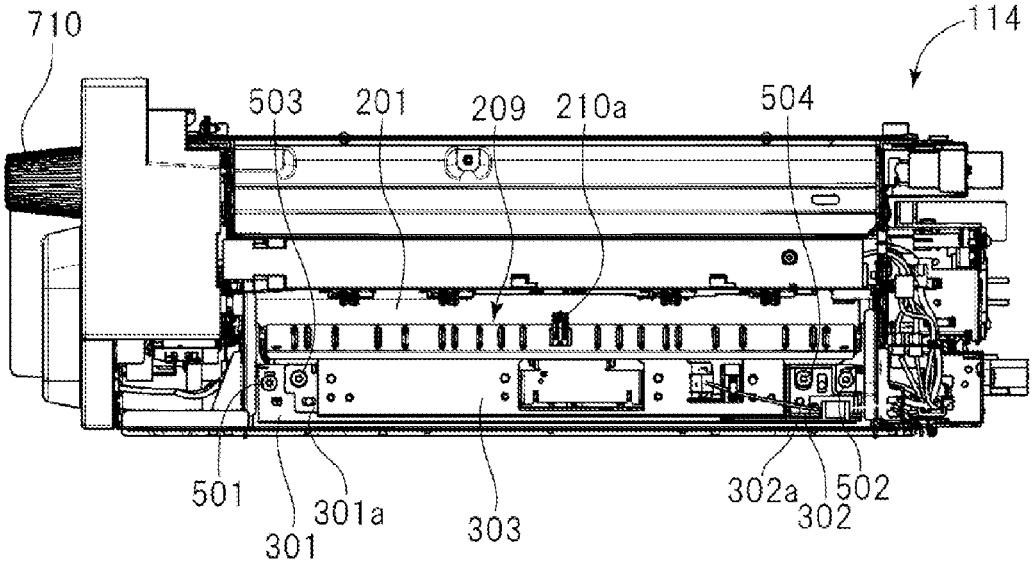
FIG. 5 is a diagram when the fixing device is viewed from an upstream side in a sheet conveying direction.

FIG. 5 is a diagram when the fixing device 114 is viewed from an upstream side thereof in the sheet conveying direction. The entrance guide 209 is fastened to the height adjustment racks 301 and 302, which are provided in the fixing device 114, through the entrance guide adjustment plates 303 and 302 with screws 501 and 502. As illustrated in FIG. 4, furthermore, a screw fastening hole 303*a* of the entrance guide adjustment plate 303 is a long hole in a vertical direction. Therefore, the entrance guide 209 is movable in the vertical direction and can be fastened to the height adjustment racks 301 and 302 in the state where the tip height of the entrance guide is adjusted by a jig.

Furthermore, when the detachment of the entrance guide 209 is required, the entrance guide 209 is detached from the height adjustment racks 301 and 302 by removing the screws 503 and 504. Here, even when the entrance guide 209 is detached, the height adjustment racks 301 and 302 are in a state of remaining in the frame. Accordingly, in a case of assembling the entrance guide 209, if the entrance guide 209 is assembled based on the embosses provided on the height adjustment racks 301 and 302, it is possible to assemble the entrance guide 209 with the height thereof in an initial adjustment state.

Meanwhile, in the present embodiment, for example, when the jamming occurs in the discharge roller 120 or a finisher (not illustrated), the controller (CPU) 104 immediately stops the operation of conveying the sheet. In addition, when the sheet is jammed by the fixing separation claw 219, if a succeeding sheet is sent, the succeeding sheet is overlapped with the preceding jammed sheet, and thus a jam recovery may be sometimes difficult. Consequently, the controller (CPU) 104 immediately stops the operation of the fixing device 114.

Figure 6:
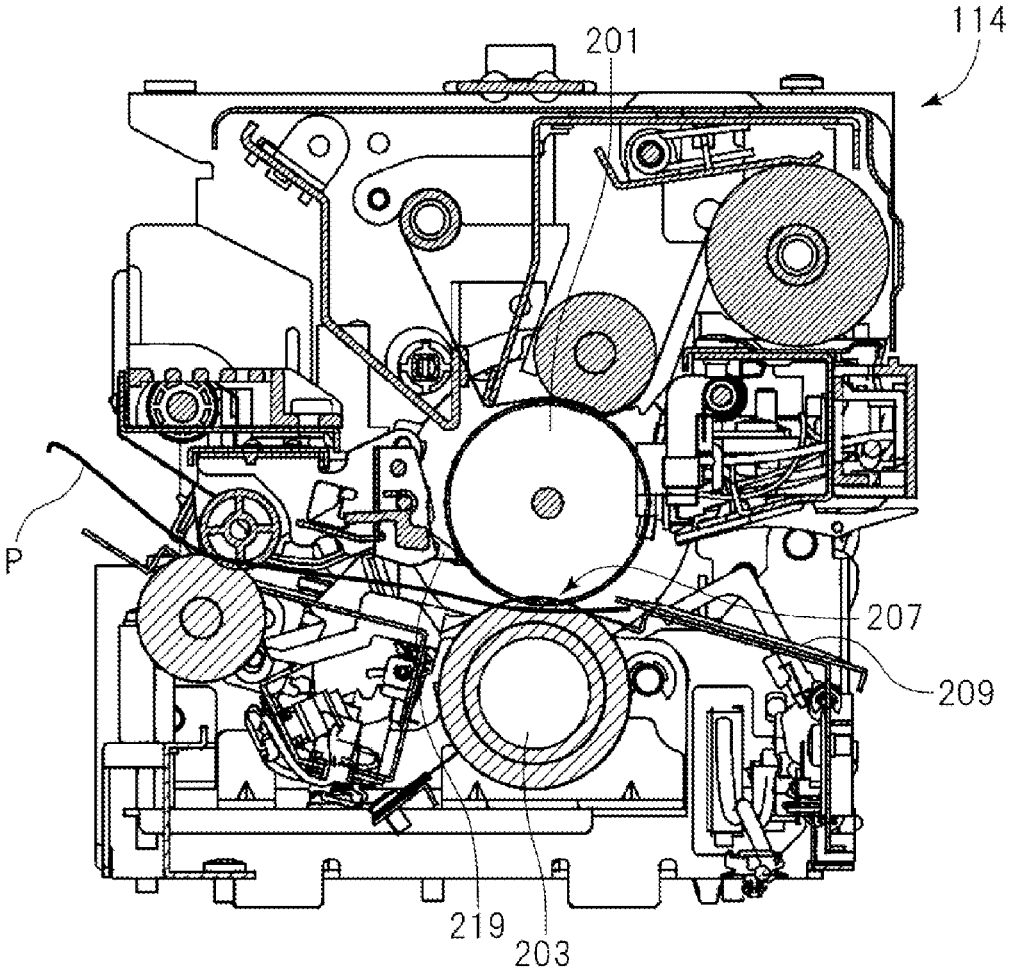
FIG. 6 is a diagram illustrating a state where a jammed sheet is stopped in a state where a trailing end of the sheet is positioned at the upstream in the sheet conveying direction of a fixing nip, in the fixing device.

However, when the sheet is jammed, as illustrated in FIG. 6, there is a case where the sheet P is stopped in the state where the trailing end of the sheet P is nipped in the fixing nip portion 207 due to a sheet size or an occurrence location of the jam in a case of making the conveyance of the sheet immediately stop. In this case, a user moves the jammed sheet by manually operating a knob to rotate the fixing roller 201 in order to recover the jammed sheet P, thereby performing the jam recovery.

At this time, however, when the fixing roller 201 is rotated in a counterclockwise direction, the jammed sheet P may reach the web 218 by slipping through the fixing separation claw 219 and moving along the fixing roller 201 depending on the state of the jammed sheet P. In this case, since the jam recovery by the user becomes difficult, the fixing roller 201 is configured so as not to rotate in the clockwise direction. That is, when the jammed sheet P is in the state of being nipped in the fixing nip portion 207, the jam recovery is performed by rotating the knob such that the fixing roller 201 is rotated in the counterclockwise direction, that is, the sheet P is reversely conveyed toward the upstream side in the sheet conveying direction which is the guide member side.

Figure 7:
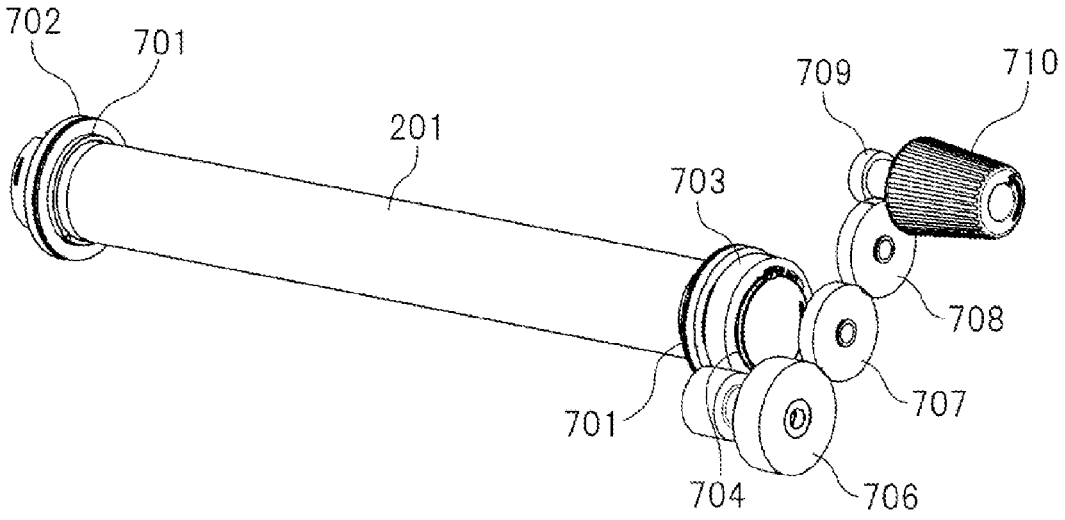
FIG. 7 is a diagram illustrating a driving system which reverses a fixing roller included in the fixing device by a manual operation.

Furthermore, FIG. 7 is a diagram illustrating a driving system which reverses the fixing roller 201 by a manual operation. The fixing roller 201 is rotatably supported on the frame by bushings 701 provided at both ends thereof and bearings 702 and 703 provided in the frame (not illustrated) of the fixing device 114. Then, a fixing driving gear 704 is disposed at the outside in an axial direction of the front-side bearing 703 so as to be fitted into a key groove (not illustrated) provided in the fixing roller 201 and be secured to the fixing roller 201.

The fixing driving gear 704 is rotated by engaging with a stage gear 706, which is rotated by a driving due to a driving motor (not illustrated), to rotate the fixing roller 201. Further, the stage gear 706 is engaged with gears 707, 708, and 709, and a knob 710 as a manual discharge member is disposed on the same axis as the gear 709. Then, when the knob 710 is rotated in an arrow direction, the fixing driving gear 704 integrally rotates with the fixing roller 201 in the counter-clockwise direction, and thus the jammed sheet is reversely conveyed and can be discharged from the fixing device 114. Further, a one-way mechanism (not illustrated) is provided between the knob 710 and the gear 709. Even when the knob 710 is reversely rotated in the arrow direction, the rotation of the knob 710 is not transmitted to the fixing roller 201 by the one-way mechanism. Accordingly, even when the knob 710 rotates in a wrong rotation direction, the sheet is never conveyed to the downstream side in the sheet conveying direction.

By the way, when the sheet is jammed, the sheet is discharged outside the fixing device by rotating the knob 710 in the arrow direction to reversely convey the sheet, but there is a case where the trailing end of the sheet P enters the lower side of the entrance guide 209 depending on the state of the jammed sheet, as illustrated in FIG. 6 described above. In the present embodiment, however, as illustrated in FIG. 4, the crank-shaped bending portion 209*g* is provided on the end of the auxiliary member 209*c* at the fixing nip portion side.

Figure 8A:
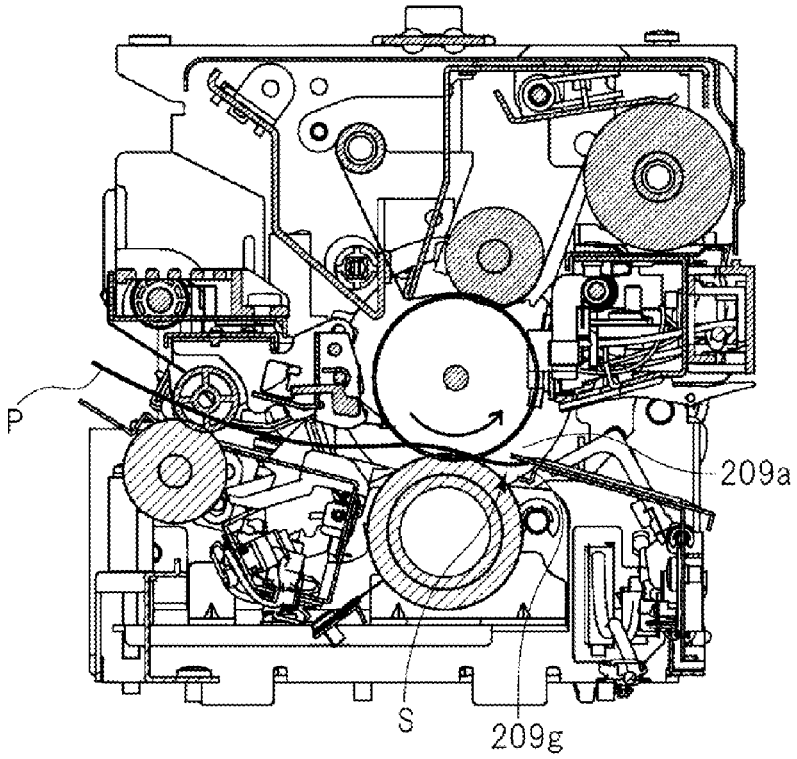
FIGS. 8A and 8B are diagrams illustrating a sheet movement when the jammed sheet is discharged toward the entrance guide by the manual operation.
Figure 8B:
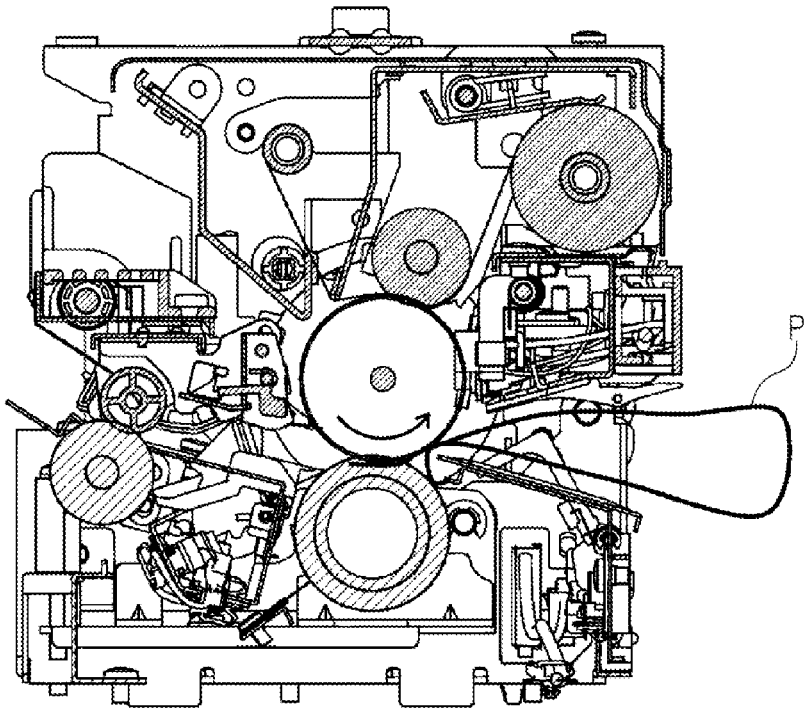

Therefore, when the jammed sheet P enters the lower part of the entrance guide 209, as illustrated in FIG. 8A, the trailing end as the downstream side end in the discharging direction of the jammed sheet P enters and is caught in the bending portion 209*g* so as to be locked to the bending portion 209*g*. Then, when the trailing end is locked in this manner, the jammed sheet P can no longer enter the lower part of the entrance guide. Consequently, when the knob is further rotated, the trailing end is pressed by the bending portion 209*g*, and the jammed sheet, which is lost in a way, protrudes from the sheet passing member 209*b*. Thereafter, as illustrated in FIG. 8B, a central portion of the sheet in the sheet discharging direction is bent along the surface of the sheet passing member 209*b*. Then, as the central portion of the sheet in the sheet discharging direction is bent along the surface of the sheet passing member 209*b* in this manner, since the central portion of the sheet in the sheet discharging direction eventually protrudes from the fixing device 114, the user can easily remove the jammed sheet.

In the present embodiment, as described above, the sheet passing member 209*b*, which is formed with the crank-shaped bending portion 209*g* as a locking member, is provided at the back side of the auxiliary member 209*c*. Further, when the sheet to be discharged enters the back side of the sheet passing member 209*b*, the trailing end of the sheet is locked to the bending portion 209*g*, and thus the central portion of the sheet in the sheet discharging direction is bent along the surface of the sheet passing member 209*b*. Therefore, since the central portion of the sheet in the sheet discharging direction eventually protrudes from the fixing device 114, the jam sheet nipped by the fixing roller 201 and the pressure roller 203 can be easily recovered.

Figure 9:
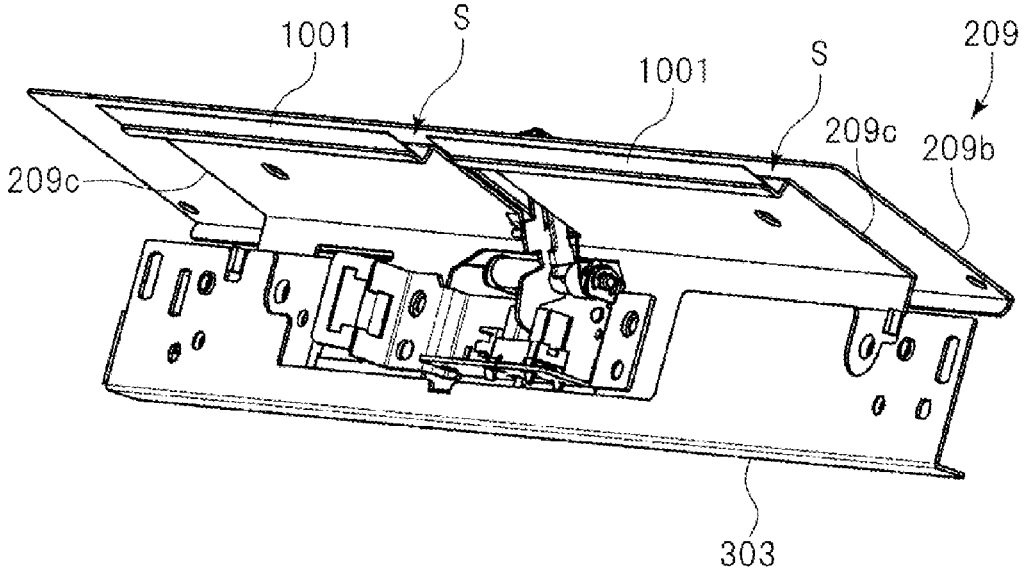
FIG. 9 is a first diagram illustrating another Configuration 1 according to the present embodiment.

Furthermore, the shape of the locking member according to the invention is not limited thereto. For example, as illustrated in FIG. 9, a guide sheet 1001 as a flexible member having heat resistance may be provided on the tip end of the auxiliary member 209*c* so as to protrude toward the fixing nip portion. Further, the heat-resistance guide sheet 1001 is a polyimide sheet with a thickness of 75 μm and is bonded to the auxiliary member 209*c* by a heat resistance double-sided tape.

Figure 10:
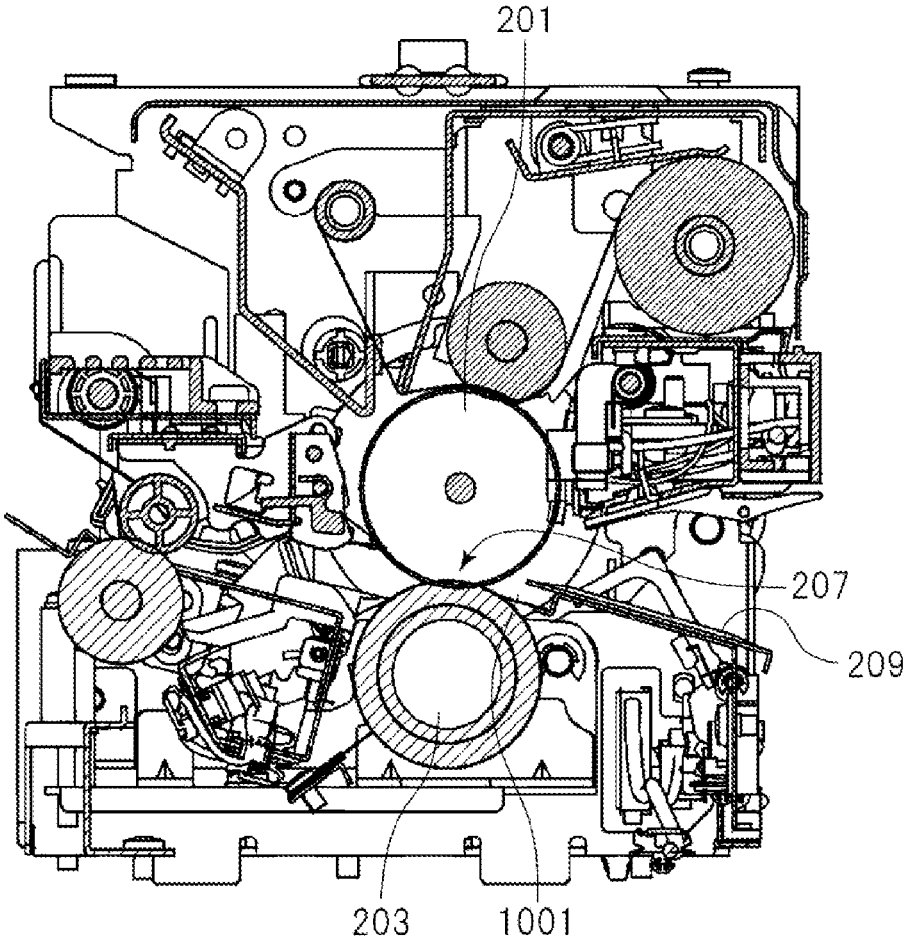
FIG. 10 is a second diagram illustrating Configuration 1 according to the present embodiment.

As illustrated in FIG. 10, as the elastic guide sheet 1001 having elasticity is provided on the auxiliary member 209*c*, a gap with the pressure roller 203 can be narrower. In addition, the guide sheet 1001 can be slipped on the pressure roller 203 by the elasticity of material itself, and it is possible to reduce a risk that the jammed sheet enters between the pressure roller 203 and the entrance guide 209 during the jam recovery.

Figure 11:
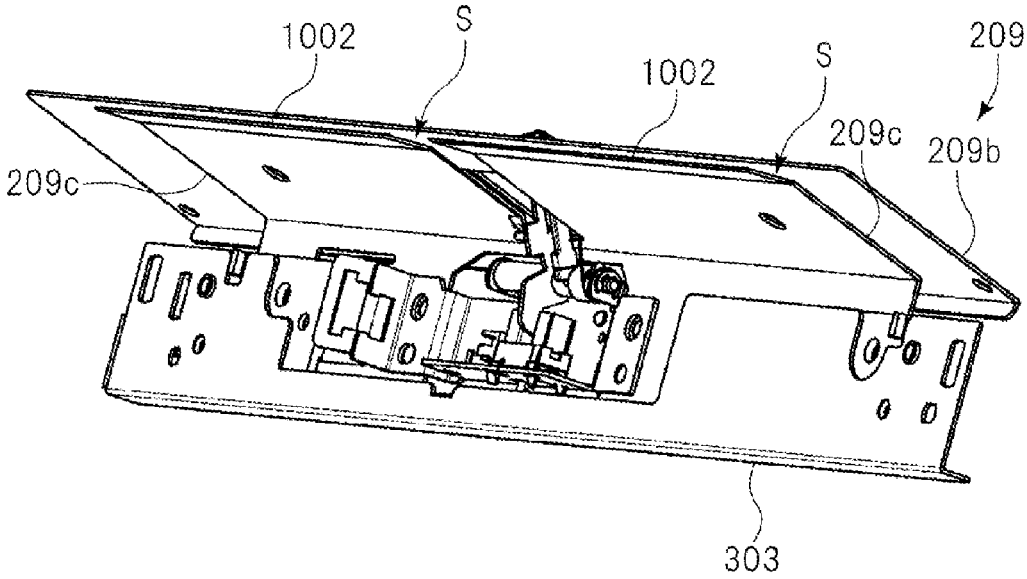
FIG. 11 is a first diagram illustrating another Configuration 2 according to the present embodiment in which the locking member is a linear plate.
Figure 12:
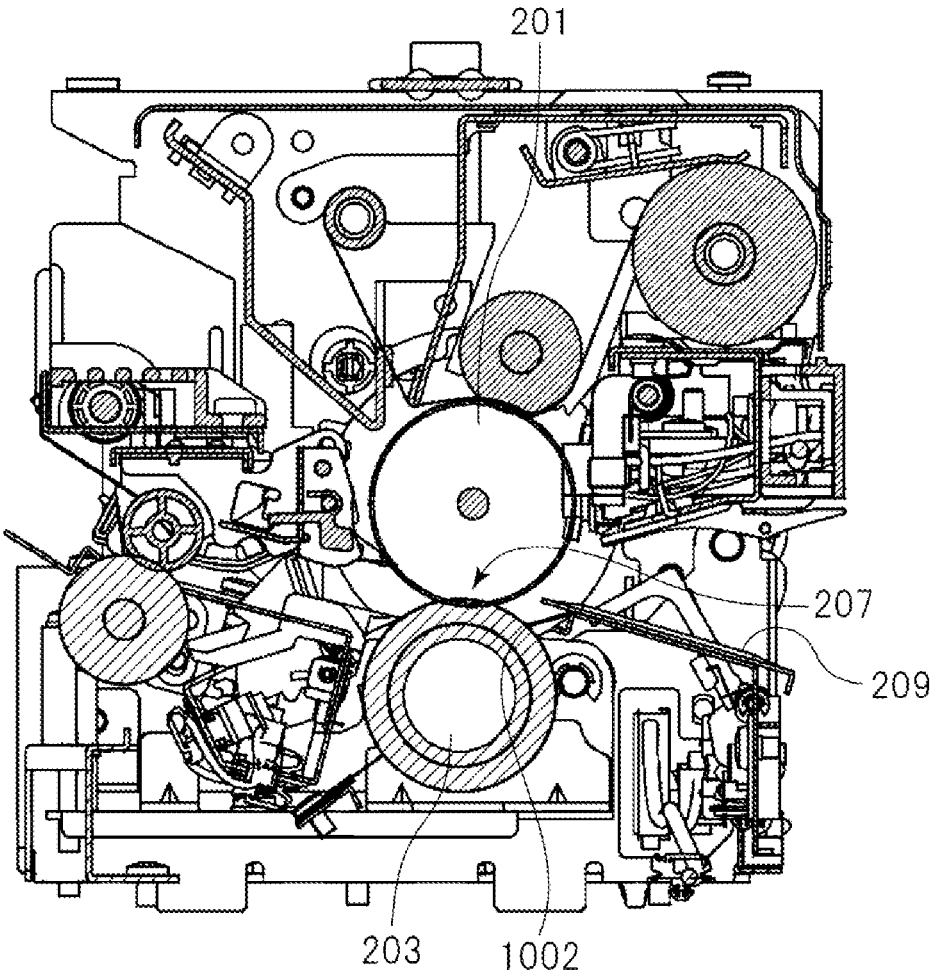
FIG. 12 is a second diagram illustrating another version of Configuration 2 according to the present embodiment in which the locking member is an L-shaped plate.
Figure 13A:
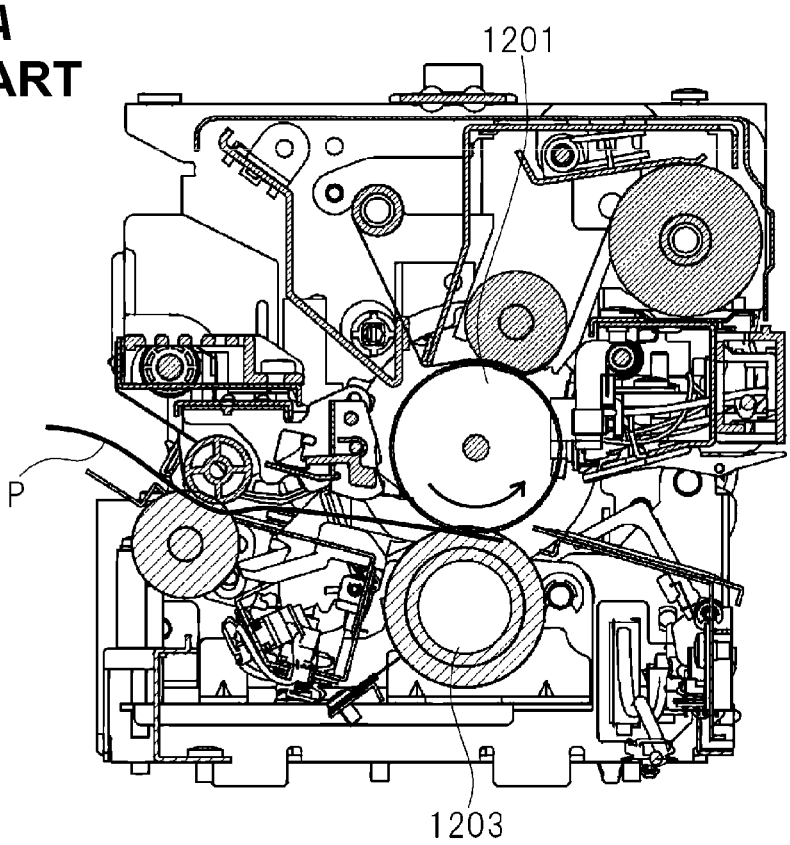
FIG. 13A PRIOR ART
FIGS. 13A and 13B are diagrams describing a configuration of a conventional fixing device.
Figure 13B:
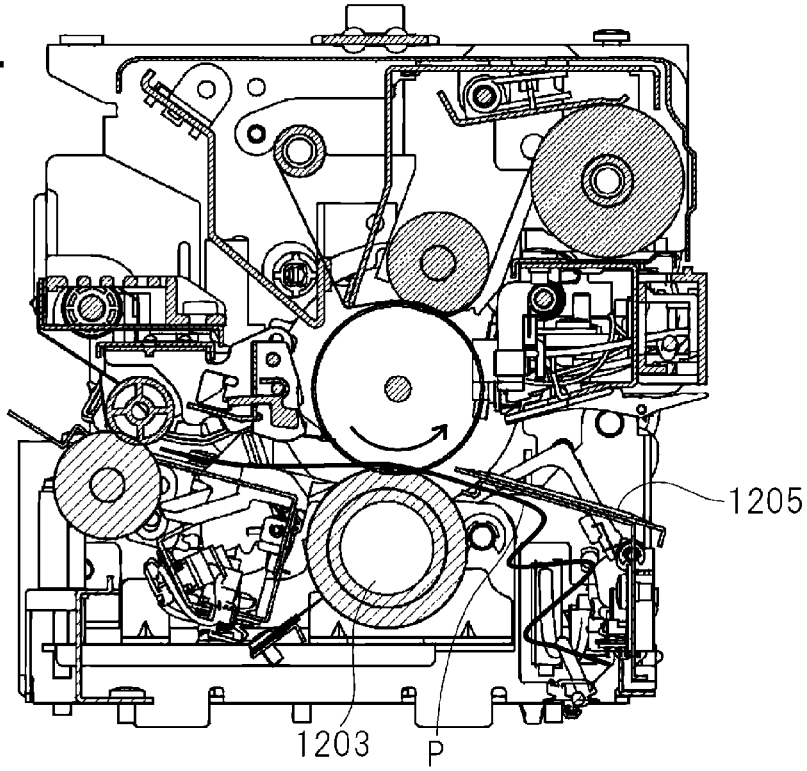
FIG. 13B PRIOR ART

In addition, as illustrated in FIGS. 11 and 12, the locking member provided on the back side of a guide face need not necessarily be formed in an L-shape, and may be formed so as to protrude a linear plate in a direction perpendicular to the sheet conveying direction.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-267225, filed Dec. 6, 2012, which is hereby incorporated by reference herein in its entirety.

What is claimed is:

1. An image forming apparatus comprising:

an image forming portion which forms a toner image;

a transfer portion which transfers the toner image onto a sheet; and a fixing device which fixes the transferred toner image on the sheet, wherein the fixing device includes:

a first rotary body;

a second rotary body which is pressed against the first rotary body;

a guide member which is disposed upstream of a nip portion between the first rotary body and the second rotary body to guide the sheet to the nip portion between the first and second rotary bodies and extends in a sheet conveying direction;

a manual member which is manually operated to move the sheet nipped by the nip portion toward the guide member; and a regulating member which is provided on a downstream side of the guide member in the sheet conveying direction and on a back side of a guide face of the guide member, which guides the sheet to the nip portion, and regulates an edge of the sheet by holding the edge in place when the sheet being moved by the manual member enters the back side of the guide member, wherein by operating the manual member, a central portion of the sheet is moved toward the guide face in a case that the edge of the sheet is regulated by the regulating member.

2. The image forming apparatus according to claim 1, wherein the regulating member is an L-shaped plate in cross-section and is provided such that an end protrudes toward the nip portion.

3. The image forming apparatus according to claim 2, wherein a flexible member is provided on the end of the regulating member at the nip portion side so as to protrude toward the nip portion.

4. The image forming apparatus according to claim 1, wherein the guide member contacts the undersurface of the sheet and guides the sheet horizontally.

5. An image forming apparatus comprising:

an image forming portion which forms a toner image;

a transfer portion which transfers the toner image onto a sheet; and a fixing device which fixes the transferred toner image on the sheet, wherein the fixing device includes:

a first rotary body;

a second rotary body which is pressed against the first rotary body;

a guide member which is disposed upstream of a nip portion between the first rotary body and the second rotary body to guide the sheet to the nip portion between the first and second rotary bodies and extends in a sheet conveying direction;

a regulating member which is provided at a downstream side of the guide member in the sheet conveying direction so as to protrude from a back side of a guide face of the guide member, which guides the sheet to the nip portion, to regulate an end of the sheet by holding the end in place in a case that a sheet moved toward the transfer portion enters the back side of the guide member.

6. The image forming apparatus according to claim 5, wherein the regulating member is an L-shaped plate in cross-section and is provided such that an end protrudes toward the nip portion.

7. The image forming apparatus according to claim 6, wherein a flexible member is provided on the end of the regulating member at the nip portion side so as to protrude toward the nip portion.

8. The image forming apparatus according to claim 6, further comprising a manual member which can move the sheet nipped at the nip portion toward the sheet guide portion.

9. The image forming apparatus according to claim 5, wherein the guide member contacts the undersurface of the sheet and guides the sheet horizontally.

* * * * *